US008671514B2

(12) United States Patent
Iles

(10) Patent No.: US 8,671,514 B2
(45) Date of Patent: Mar. 18, 2014

(54) CLEANER HEAD

(75) Inventor: Jean-Paul Mark Iles, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 13/368,538

(22) Filed: Feb. 8, 2012

(65) Prior Publication Data

US 2012/0198644 A1 Aug. 9, 2012

(30) Foreign Application Priority Data

Feb. 8, 2011 (GB) ..... 1102131.8

(51) Int. Cl.
*A47L 9/04* (2006.01)

(52) U.S. Cl.
USPC ..... 15/383; 15/354

(58) Field of Classification Search
USPC ..... 15/383–392, 415.1, 422, 362, 354–361
See application file for complete search history.

(56) References Cited

U.S. PATENT DOCUMENTS

| | | | | |
|---|---|---|---|---|
| 4,171,554 | A * | 10/1979 | Tschudy | 15/359 |
| 6,122,798 | A * | 9/2000 | Kobayashi et al. | 15/387 |
| 7,467,439 | B2 * | 12/2008 | Lijzenga et al. | 15/373 |
| 2004/0172784 | A1 * | 9/2004 | Downey et al. | 15/384 |
| 2010/0306959 | A1 * | 12/2010 | Follows et al. | 15/383 |
| 2011/0214248 | A1 * | 9/2011 | McLeod et al. | 15/383 |

FOREIGN PATENT DOCUMENTS

| | | | | |
|---|---|---|---|---|
| EP | 2 116 165 | | 11/2009 | |
| JP | 1-259824 | | 10/1989 | |
| JP | 1-262825 | | 10/1989 | |
| JP | 2003033303 | A * | 2/2003 | A47L 9/04 |
| WO | WO-2008/050235 | | 5/2008 | |
| WO | WO-2010/142968 | | 12/2010 | |

OTHER PUBLICATIONS

JP2003033303A (machine translation), 2003.*
Search Report and Written Opinion mailed Apr. 26, 2012, directed to International Patent Application No. PCT/GB2012/050069; 11 pages.
GB Search Report dated Jun. 8, 2011, directed to counterpart GB Application No. 1102131.8; 1 page.

* cited by examiner

*Primary Examiner* — Mark Spisich
*Assistant Examiner* — Andrew A Horton
(74) *Attorney, Agent, or Firm* — Morrison & Foerster LLP

(57) ABSTRACT

A cleaner head for a cleaning appliance includes a rotatable agitator assembly, an agitator chamber housing the agitator assembly, and a sole plate defining a downwardly-directed opening through which debris energized by the agitator assembly enters the agitator chamber. A set of support members is located on a leading and trailing section of the sole plate, the support members extending downwardly beyond the sole plate to support the sole plate above a relatively hard floor surface. The lowermost extremities of the sets of support members are located in a first plane, and the edges of the opening are located in a second plane which is inclined upwardly relative to the first plane. The agitator assembly includes agitating members which extend outwardly from the opening beyond the second plane but within the first plane.

18 Claims, 5 Drawing Sheets

CLEANER HEAD

REFERENCE TO RELATED APPLICATIONS

This application claims the priority of United Kingdom Application No. 1102131.8, filed Feb. 8, 2011, the entire contents of which are incorporated herein by reference.

FIELD OF THE INVENTION

The present invention relates to a cleaner head for a cleaning appliance. In a preferred embodiment, the cleaner head is suitable for use with a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening and the cleaner head, and into the main body. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement.

Vacuum cleaners generally include cylinder, or canister, cleaners, upright cleaners and hand-held cleaners. A cylinder vacuum cleaner includes a main body supported by a set of wheels which is dragged along a floor surface by a hose and wand assembly extending between the main body and the cleaner head. The cleaner head is generally releasably attached to the end of the wand which is remote from the main body. An upright vacuum cleaner typically comprises a main body, a rolling assembly mounted on the main body for maneuvering the vacuum cleaner over a floor surface to be cleaned, and a cleaner head mounted on the main body. In use, a user reclines the main body of the upright vacuum cleaner towards the floor surface, and then sequentially pushes and pulls a handle which is attached to the main body to maneuver the vacuum cleaner over the floor surface.

A driven agitator, usually in the form of a brush bar, may be rotatably mounted within a brush bar chamber of the cleaner head. The brush bar comprises an elongate cylindrical core bearing bristles which extend radially outward from the core. The bristles are generally provided in clumps or tufts of bristles spaced about and along the core of the brush bar. The suction opening is located at the bottom of the brush bar chamber, and the brush bar is mounted within the chamber so that the bristles protrude by a small extent through the suction opening. An exhaust port of the brush bar chamber is generally located towards the rear of the brush bar chamber. The exhaust port is usually in the form of a circular or rectangular aperture formed in the brush bar chamber.

The brush bar is activated mainly when the vacuum cleaner is used to clean carpeted surfaces. Rotation of the brush bar about its longitudinal axis may be driven by an electric motor powered by a power supply derived from the main body of the cleaner, or by a turbine driven by an air flow passing through or into the cleaner head. The rotation of the brush bar causes the bristles to be swept between the fibers of the carpet to be cleaned, agitating both the fibers of the carpet and any debris, such as dust particles, fibers and hairs, located on the surface of the carpet and/or between the fibers of the carpet.

WO 2010/142968 describes a cleaner head having a brush bar bearing two different types of bristles which each protrude through the suction opening with rotation of the brush bar. The suction opening is located within a planar sole plate of the cleaner head. The brush bar has a number of rows of relatively stiff, short bristles arranged in a series of tufts regularly spaced along the rows, and a number of rows of relatively soft, long bristles which extend radially outwardly from the brush bar beyond the relatively short bristles. The cleaner head includes wheels which support the cleaner head on a floor surface so that when the cleaner head is located on a hard floor surface, the sole plate is spaced from that surface. A first plane containing the lowermost extremities of the wheels is parallel to a second plane containing the sole plate and the suction opening.

The lengths of the bristles are selected so that when the cleaner head is located on a hard floor surface, the relatively long bristles engage the floor surface whereas the relatively short bristles are spaced from the floor surface to prevent those bristles from marking the floor surface. When the cleaner head is moved on to a carpeted floor surface, the rolling elements sink between the fibers of the carpet to bring the sole plate and the relatively short bristles into contact with the carpet.

In order to improve the pick up performance of the cleaner head when it is located on a hard floor surface, it is desirable to locate the suction opening as close as possible to the floor surface. For example, the cleaner head may be designed so that the distance between the sole plate and the hard floor surface is no greater than 1 mm. In this case, the tips of the relatively short bristles must not protrude beyond the sole plate by a distance which is greater than 1 mm so that the relatively short bristles are spaced from the hard floor surface. This can require careful control of a number of the manufacturing parameters associated with the cleaner head so that they are within their prescribed engineering tolerances. These parameters include the length of the relatively short bristles, the distance between the rotational axis of the brush bar and the sole plate, the radius of the wheels, and the distance between the rotational axes of the wheels and the sole plate. The manufacture of the cleaner head and its various components to such tight engineering tolerances can increase significantly the cost of the cleaner head. On the other hand, if the cleaner head and its components are not manufactured to such tight tolerances, then there may be a relatively high rejection rate of manufactured cleaner heads on the production line, for example if the relatively short bristles do not protrude from the suction opening or if the relatively short bristles protrude from the opening beyond the first plane.

SUMMARY OF THE INVENTION

In a first aspect the present invention provides a cleaner head for a cleaning appliance, the cleaner head comprising a rotatable agitator assembly, an agitator chamber housing the agitator assembly, a sole plate defining a downwardly-directed opening through which debris energized by the agitator assembly enters the agitator chamber, the opening having a front edge and a rear edge, the sole plate having a leading section extending forwardly from the front edge of the opening and a trailing section extending rearwardly from the rear edge of the opening, and at least one support member located on each section of the sole plate, the support members extending downwardly beyond the sole plate, the support members having a thickness which is less than 5 mm, wherein the lowermost extremities of the support members are located in a first plane and the edges of the opening are located in a second plane which is inclined upwardly relative to the first plane, and the agitator assembly comprises agitating means which extend outwardly from the opening beyond the second plane but within the first plane.

The opening of the sole plate, which extends between the front and rear edges, is thus located within a second plane which is inclined upwardly relative to a first plane containing the lowermost extremities of the support members. As a result of the inclination of the second plane relative to the first plane, the central region of the opening, from which the agitating means tend to protrude by the greatest extent, can be raised above the first plane by a distance which is greater than when the second plane is parallel to the first plane (and while maintaining the same distance between the first plane and the front edge of the opening). This allows the distance by which the agitating means may protrude through the opening, while still within the constraint that the agitating means do not extend beyond the first plane, to be increased, thereby facilitating the manufacture of the cleaner head.

The extent of this increase in the distance by which the agitating means may protrude from the opening depends on the width of the opening, as measured between the front and rear edges of the opening, and the angle between the first plane and the second plane. The width of the opening is preferably between 20 and 40 mm. An angle subtended between the first plane and the second plane is preferably less than 10°, and is more preferably less than 5°. For example, in a preferred embodiment the width of the opening is around 25 mm, and the angle between the first plane and the second plane is around 3°. This allows the agitating means to protrude through the opening by a distance of around 1.5 mm without extending beyond the first plane. In additional to relaxing the manufacturing tolerances, this can allow improve the cleaning performance of the cleaner head on a carpeted floor surface by increasing the penetration of the agitating means between the fibers of the carpet; when the cleaner head is located on a carpet, the support members will sink between the fibers of the carpet to bring the rear edge of the opening into contact with the surface of the carpet.

The sole plate is preferably pivotable relative to the agitator chamber to move the rear edge of the opening into contact with the surface of the carpet as the support members sink between the fibers of the carpet. For example, the sole plate may be pivotably connected to a main body of the cleaner head which defines the agitator chamber. As the cleaner head is pulled backwards over a carpeted floor surface by a user, there is a tendency for the user to raise the rear of the cleaner head, and so this pivoting movement of the sole plate also allows the edges of the opening to be kept in contact with this floor surface during cleaning. This can enable a seal to be maintained between the edges of the opening and the floor surface during cleaning, which can improve the pick up performance of the cleaner head. The sole plate is preferably pivotable relative to the agitator chamber about a pivot axis which is substantially parallel to the front edge of the opening.

To improve the seal between the sole plate and the surface of the carpet, a bottom surface of one of the sections of the sole plate may be located substantially within the second plane so that that surface of the sole plate rides over the surface of the carpet to form a seal which extends over substantially the entire surface area of that section of the sole plate. In a preferred embodiment, this section of the sole plate is the trailing section of the sole plate, but the orientation of the cleaner head may be varied so that it is preferable to have the leading section of the sole plate located within the second plane. Alternatively, the bottom surface of this section of the sole plate may be located beneath the second plane, and may be contained within a third plane which intersects the second plane along the rear edge of the opening. In this case, when the cleaner head is located on a carpet, the front edge of the opening is located beneath the second plane so as to agitate the fibers of the carpet as the cleaner head is maneuvered over the surface of the carpet. An angle subtended between the second plane and the third plane is preferably lower than 5°, and more preferably lower than 2°.

The angle subtended between the first plane and the second plane is preferably relatively small to minimize the distance between the first plane and the rear end of the trailing section of the sole plate. For example, in the aforementioned embodiment the rear end of the trailing section of the sole plate may be raised by a distance of around 3 to 4 mm from the first plane. To improve the performance of the cleaner head when it is located on a hard floor surface, the cleaner head preferably comprises flexible surface engaging means extending downwardly from the trailing section of the sole plate for forming a seal with the surface on which the cleaner head is located. The surface engaging means preferably extends along substantially the entire length of the trailing section, preferably adjacent to the rear edge of the opening and between the rear edge and the support member(s) located on the trailing section of the sole plate. The surface engaging means may comprise a strip of flexible material, or a row of bristles. The bristles may be formed from nylon, and are preferably relatively flexible in order to allow the bristles to deform readily to lie flat against the trailing section of the sole plate when the cleaner head is located on a carpeted floor surface so as not to disturb the seal formed between the sole plate and the surface of the carpet and to present only a low resistance to motion of the cleaner head over the carpet.

The bottom surface of the other section of the sole plate, which in the aforementioned embodiment is the leading section of the sole plate, is preferably inclined to the second plane. The bottom surface of the other section of the sole plate may be located in a plane which is substantially parallel to the first plane, but it is preferably located in a plane which is inclined upwardly relative to the first plane. This allows the leading section to guide the fibers of a rug or deeply piled carpeted floor surface beneath the cleaner head and into the opening as the cleaner head is maneuvered forwardly over that floor surface, thereby lowering the resistance to forward motion of the cleaner head over the floor surface.

The agitating means preferably comprises one or more agitating members, and may comprise one or more of a plurality of bristles, a plurality of filaments, and at least one strip of material.

For sweeping dirt and dust from a hard floor surface, the agitator assembly may be provided with additional agitating means which extend outwardly from the opening beyond both the first plane and the second plane. In a second aspect, the present invention provides a cleaner head for a cleaning appliance, the cleaner head comprising a rotatable agitator assembly, an agitator chamber housing the agitator assembly, a sole plate defining a downwardly-directed opening through which debris energized by the agitator assembly enters the agitator chamber, the opening having a front edge and a rear edge, the sole plate having a leading section extending forwardly from the front edge of the opening and a trailing section extending rearwardly from the rear edge of the opening, and at least one support member located on each section of the sole plate, the support members extending downwardly beyond the sole plate, the support members having a thickness which is less than 5 mm, wherein the lowermost extremities of the support members are located in a first plane and the edges of the opening are located in a second plane which is inclined upwardly relative to the first plane, and the agitator assembly comprises first agitating means which extend outwardly from the opening beyond the second plane but within the first plane and second agitating means which extend outwardly from the opening beyond both the first plane and the second plane.

The second agitating means may be formed from material having a lower surface resistivity than that from which the first agitating means is formed. This can inhibit charging of a hard floor surface with static electricity upon contact with the second agitating means. This allows fine dust and powder which would otherwise be attracted to the floor surface to be dislodged from the floor surface by the second agitating means.

The surface resistivity of the second agitating means is preferably in the range from $1\times10^{-5}$ to $1\times10^{12}$ Ω/sq (ohms per square). Values of surface resistivity discussed herein are as measured using the test method ASTM D257. The second agitating means is preferably formed from one of metallic, carbon fiber, carbon composite or other composite material. For example, material comprising carbon particles and carbon fibers generally has a surface resistivity in the range from $1\times10^{3}$ to $1\times10^{6}$ Ω/sq, whereas metallic material generally has a much lower surface resistivity, generally lower than 1 Ω/sq. Other static dissipative materials generally have a surface resistivity in the range from $1\times10^{5}$ to $1\times10^{12}$ Ω/sq.

The first agitating means may be formed from electrically insulating, plastics material, such as nylon, and so may have a surface resistivity in the range from $1\times10^{12}$ to $1\times10^{16}$ Ω/sq. Alternatively, the first agitating means may be formed from a similar material as the second agitating means, and so may have a surface resistivity within the aforementioned range for the second agitating means, in order to inhibit the build-up of static electricity on a carpeted floor surface.

The first agitating means is preferably spaced from the second agitating means. However, the first agitating means may be located within, or otherwise in contact with, the second agitating means. For example, each of the agitating means may comprise a plurality of bristles or filaments, with the bristles or filaments of the first agitating means being located adjacent, or amongst, bristles or filaments of the second agitating means.

Preferably, the second agitating means protrudes outwardly beyond the first agitating means by a distance in the range from 0.5 to 5 mm, more preferably by a distance in the range from 1 to 3 mm.

The first agitating means may be moveable relative to the second agitating means. For example the first and second agitating means may be mounted on or otherwise comprise respective bodies which are moveable relative to each other. By way of example, the first agitating means may be mounted on a first body which is rotated about a first axis or translated in a first direction, and the second agitating means may be mounted on a second body which is rotated about a second axis or translated in a second direction. In a preferred embodiment, however, the first agitating means and the second agitating means are rotatable about a common axis, and are preferably mounted on a common rotatable body. This body may be in the form of a disc or plate, with the first and second agitating means being mounted on the same side of that disc or plate so that the second agitating means protrudes outwardly from that side beyond the first agitating means. Preferably though, the second agitating means protrudes radially outwardly from the body beyond the first agitating means. The agitating means may be arranged in any desired pattern, or randomly, on the body. In a preferred embodiment, each of the agitating means is arranged in at least one helical formation along the body.

One, or both, of the agitating means may comprise a plurality of bristles, filaments or other agitating members. For example, one or both agitating means may comprise at least one strip of material mounted on the body. Where the first agitating means comprises a plurality of bristles, these bristles are preferably arranged in one or more rows of clusters or tufts of bristles connected to the body. The second agitating means is preferably arranged in a plurality of rows along the body. However, where the second agitating means comprises a plurality of bristles or filaments, each row of bristles or filaments is preferably continuous so that no patterns of dirt or dust are formed on the floor surface as each row is swept thereover. Similarly, where the second agitating means comprises at least one strip of material, each row is preferably formed from a single strip of material, or from a plurality of adjoining strips. For example, bristles of the second agitating means may be formed from carbon fibers or conductive acrylic fibers such as Thunderon® fibers.

The first agitating means is preferably relatively stiff in comparison to the second agitating means. For example, bristles or filaments of the first agitating means may have a greater diameter than bristles or filaments of the second agitating means. Bristles of the first agitating means preferably have a diameter in the range from 100 to 500 μm. Bristles of the second agitating means preferably have a diameter in the range from 5 to 500 μm.

The agitating apparatus is preferably in the form of a rotatable brush bar.

Features described above in connection with the first aspect of the invention are equally applicable to the second aspect of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
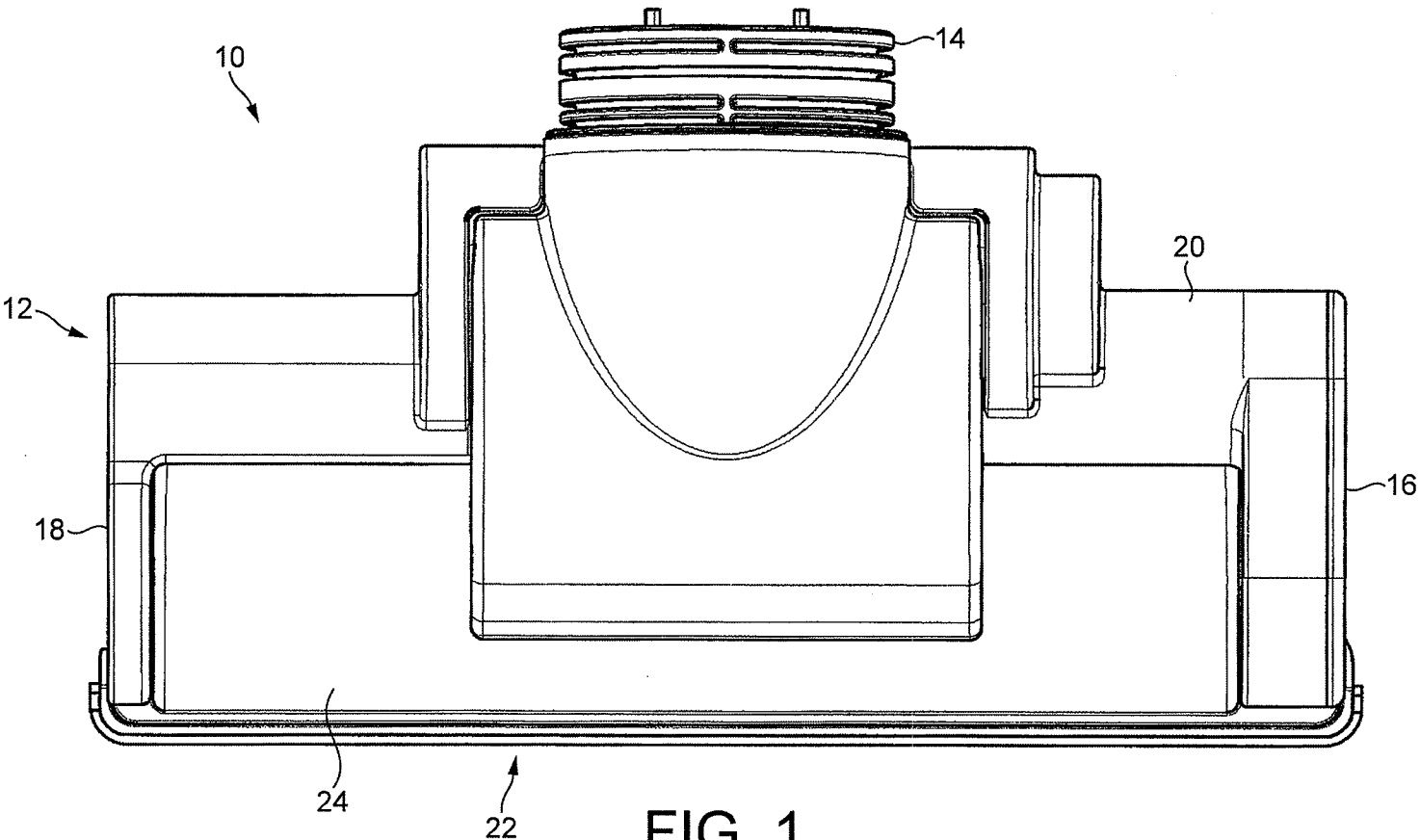
FIG. 1 is a top view of a cleaner head.
Figure 2:
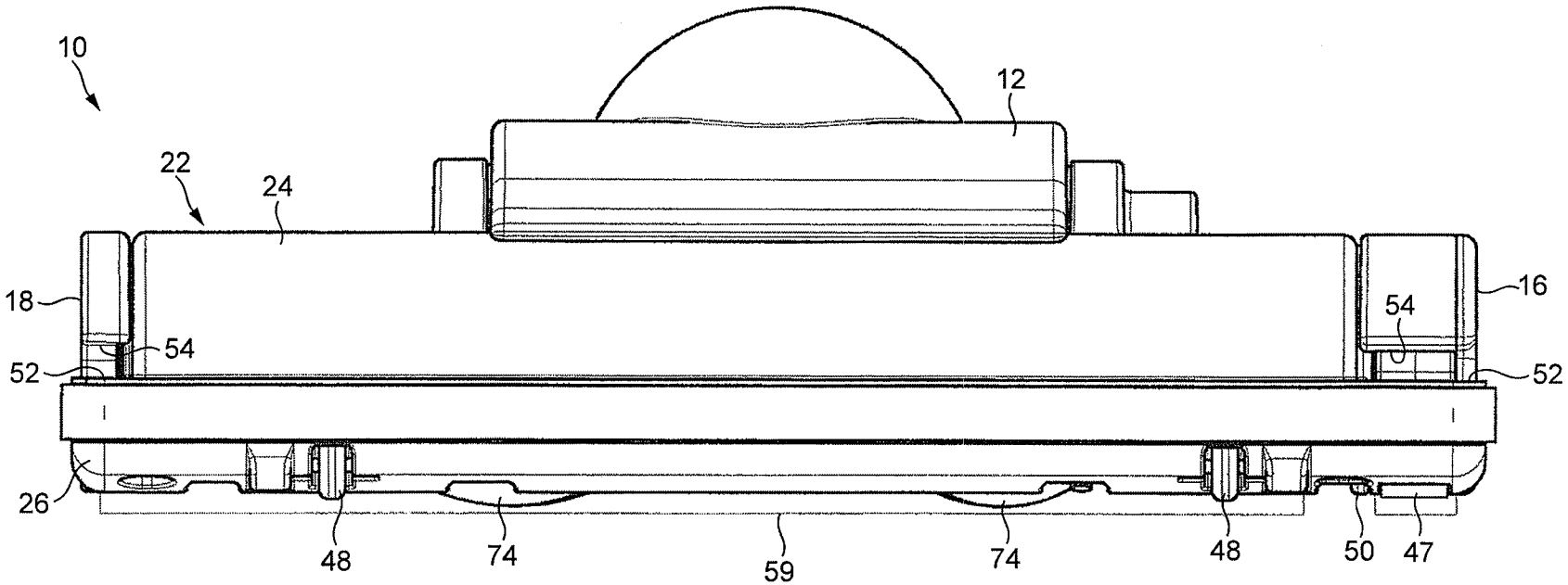
FIG. 2 is a front view of the cleaner head.
Figure 3:
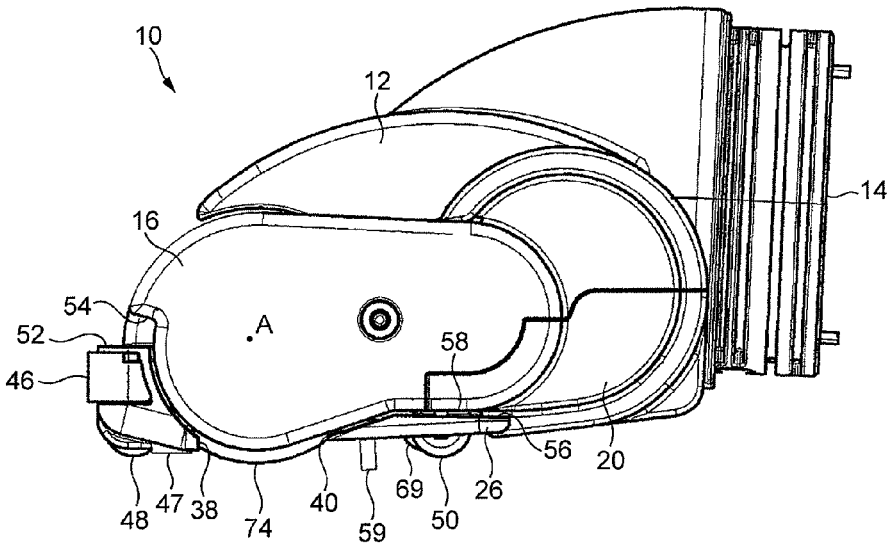
FIG. 3 is a left side view of the cleaner head.
Figure 4:
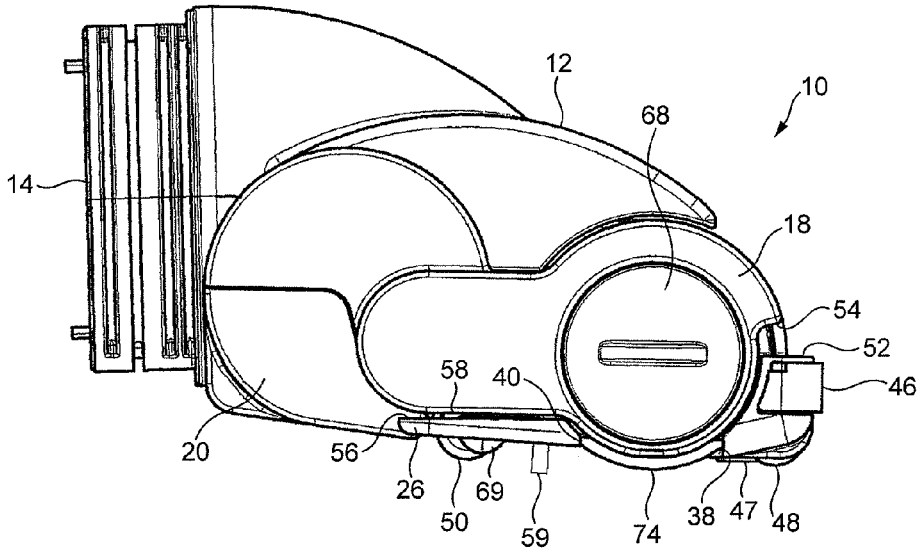
FIG. 4 is a right side view of the cleaner head.

FIGS. 1 to 5 are external views of an embodiment of a cleaner head 10 for a cleaning appliance. In this embodiment, the cleaner head 10 is arranged to be connectable to a wand or hose of a cylinder vacuum cleaning appliance. The cleaner head 10 comprises a main body 12 and a conduit 14 connected to the main body 12. The main body 12 comprises substantially parallel side walls 16, 18 extending forwardly from opposite ends of a rear section 20 of the main body 12, and a moveable section 22 located between the side walls 16, 18 of the main body 12. In this embodiment the moveable section 22 is rotatably connected to the main body 12 for rotation about an axis which extends generally orthogonally between the side walls 16, 18 of the main body 12.

The moveable section 22 comprises a curved upper wall 24, a lower plate, or sole plate 26, and two side walls 28, 30 which connect the sole plate 26 to the upper wall 24. The side walls 28, 30 are located between the side walls 16, 18 of the main body 12, with each side wall 28, 30 being located adjacent and substantially parallel to a respective one of the side walls 16, 18 of the main body 12. In use, the sole plate 26 faces the floor surface to be cleaned and, as described in more detail below, engages the surface of a carpeted floor surface. The sole plate 26 comprises a leading section 32 and a trailing section 34 located on opposite sides of a suction opening 36 through which a dirt-bearing air flow enters the cleaner head 10. The suction opening 36 is generally rectangular in shape, and is delimited by the side walls 28, 30, a relatively long front wall 38 and a relatively long rear wall 40 which each upstand from the bottom surface of the sole plate 26. These walls also delimit the start of a suction passage through the main body 12 of the cleaner head 10.

The sole plate 26 comprises two working edges for agitating the fibers of a carpeted floor surface as the cleaner head 10 is maneuvered over such a surface. A front working edge 42 of the sole plate 26 is located at the intersection between the front wall and the bottom surface of the leading section 32 of the sole plate 26, and extends substantially uninterruptedly between the side walls 28, 30. A rear working edge 44 of the sole plate 26 is located at the intersection between the rear wall 40 and the bottom surface of the trailing section 34 of the sole plate 26, and extends substantially uninterruptedly between the side walls 28, 30. The working edges 42, 44 are preferably relative sharp, preferably having a radius of curvature less than 0.5 mm.

A front bumper 46 is over-molded on to the moveable section 22, and is located between the upper wall 24 and the sole plate 26. A relatively short lint picker strip 47 is attached to one side of the bottom surface of the leading section 32 of the sole plate 26.

Figure 6:
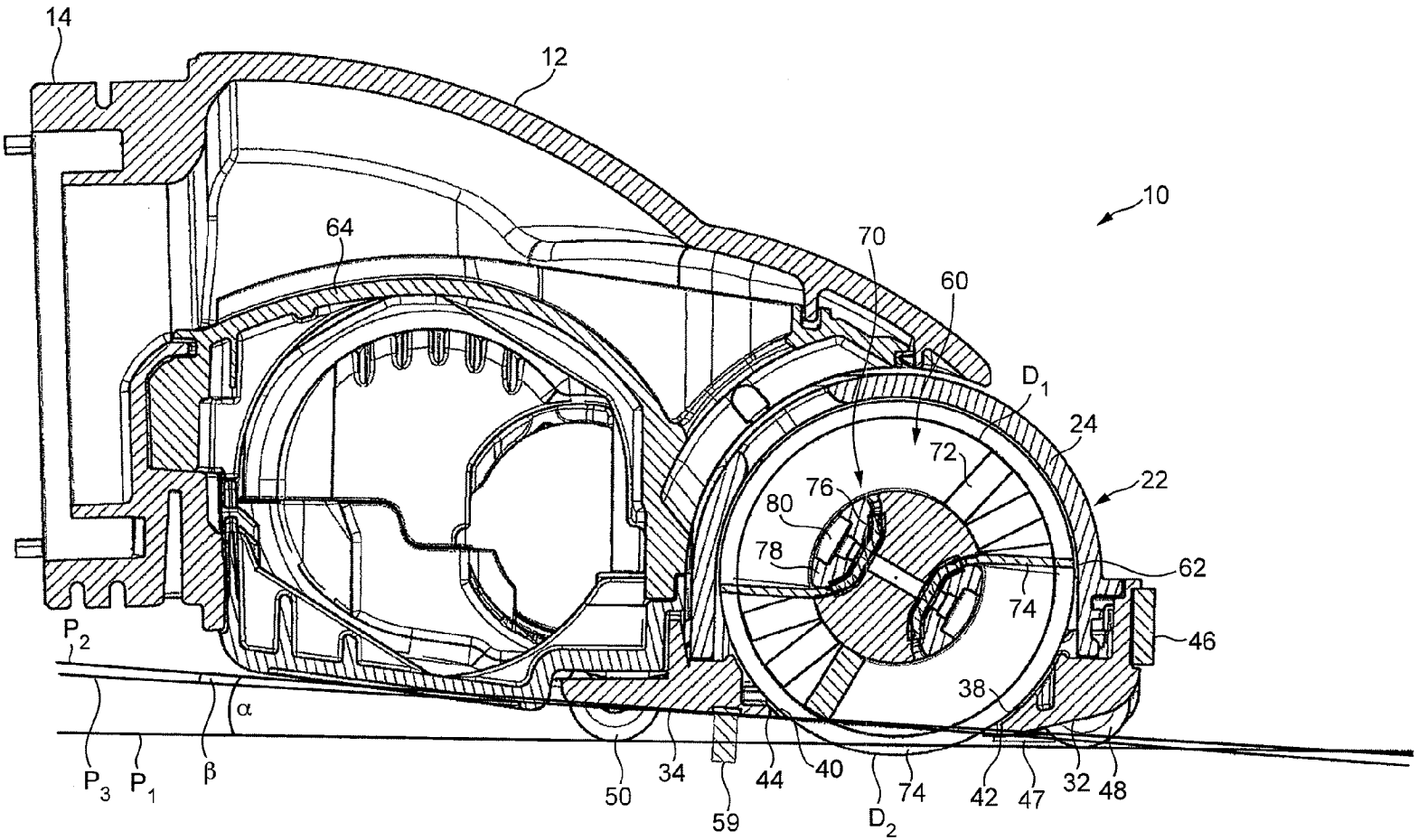
FIG. 6 is a sectional side view, taken along line A-A in FIG. 5.

To prevent the working edges 42, 44 from scratching or otherwise marking a hard floor surface as the cleaner head 10 is maneuvered over such a surface, the cleaner head 10 comprises surface engaging support members which serve to space the working edges 42, 44 from a hard floor surface. In this embodiment, the cleaner head 10 comprises a plurality of surface engaging support members which are each in the form of a rolling element, preferably a wheel. A first pair of wheels 48 is rotatably mounted within a pair of recesses formed in the leading section 32 of the sole plate 26, and a second wheel 50 is rotatably mounted within a recess formed in the trailing section 34 of the sole plate 26. An additional wheel 50 may be provided on the trailing section 34 of the sole plate 26. As illustrated in FIG. 6, the wheels 48, 50 protrude downwardly beyond the working edges 42, 44 so that the lowermost extremities of the wheels 48, 50 are located within a first plane $P_1$ which is disposed beneath the working edges 42, 44.

During use, a pressure difference is generated between the air passing through the cleaner head 10 and the external environment. This pressure difference generates a force which acts downwardly on the cleaner head 10 towards the floor surface. When the cleaner head 10 is located on a carpeted floor surface, the wheels 48, 50 are pushed into the fibers of the carpeted floor surface under the weight of the cleaner head 10 and the force acting downwardly on the cleaner head 10. The thickness of the wheels 48, 50 is selected so that the wheels 48, 50 will readily sink into the carpeted floor surface to bring at least the working edges 42, 44 of the sole plate 26 into contact with the fibers of the floor surface. The thickness of the wheels 48, 50 is preferably less than 5 mm to ensure that the wheels 48, 50 sink between the fibers of a carpeted floor surface. The thickness of the wheels 48, 50 is preferably in the range from 1 to 5 mm, for example in the range from 2 to 3 mm.

The working edges 42, 44 of the sole plate 26 are located within a second plane $P_2$ which is inclined upwardly relative to the first plane $P_1$. An angle $\alpha$ subtended between the first plane and the second plane is preferably less than 10°, more preferably less than 5° and in this embodiment is around 3°. The bottom surface of the leading section 32 of the sole plate 26 is inclined upwardly and forwardly relative to the second plane $P_2$. As a result, in use, the leading section 32 can guide the fibers of a rug or deeply piled carpeted floor surface beneath the cleaner head 10 and into the suction opening 36 as the cleaner head 10 is maneuvered forwardly over that floor surface, thereby lowering the resistance to forward motion of the cleaner head 10 over the floor surface. The bottom surface of the trailing section 34 of the sole plate 26 is inclined upwardly and rearwardly relative to the first plane $P_1$. As a result, in use, the trailing section 34 can guide the fibers of a rug or deeply piled carpeted floor surface beneath the cleaner head 10 and into the suction opening 36 as the cleaner head 10 is maneuvered rearwardly over that floor surface, thereby lowering the resistance to the rearward motion of the cleaner head 10 over the floor surface. The bottom surface of the trailing section 34 of the sole plate 26 is located within a third plane $P_3$ which intersects the second plane $P_2$ along the rear working edge 44 of the suction opening 36 so that the bottom surface of the trailing section 34 of the sole plate 26 is located beneath the second plane $P_2$. An angle $\beta$ subtended between the second plane $P_2$ and the third plane $P_3$ is preferably lower than 5°, more preferably lower than 2°, and in this example is around 1°.

As the cleaner head 10 is pulled backwards over a carpeted floor surface by a user, there is a tendency for the user to raise the rear section 20 of the main body 12 of the cleaner head 10. However, the rotatable connection of the moveable section 22 to the main body 12 allows the sole plate 26 to pivot relative to the main body 12 to maintain the working edges 42, 44 in contact with the floor surface. Clockwise rotation of the moveable section 22 relative to the main body 12 (as viewed along axis A in FIG. 3) is restricted through the abutment of upwardly facing surfaces 52 located toward the ends of the bumper 46 of the moveable section 22 with downwardly facing surfaces 54 located towards the front of the side walls 16, 18 of the main body 12. Anticlockwise rotation of the moveable section 22 relative to the main body 12 is restricted through the abutment of the upper surface 56 of the trailing section 34 of the sole plate 26 with the bottom surfaces 58 of the side walls 16, 18 of the main body 12. Clockwise rotation of the moveable section 22 relative to the main body 12 brings the bottom surface of the trailing section 34 of the sole plate 26 into contact with the upper surface of the carpet, enabling a seal to be formed between the carpet and the sole plate 26 which extends over substantially all of the surface area of the bottom surface of the trailing section 34. Due to the inclination between the second plane $P_2$ and the third plane $P_3$, the front working edge 42 is located beneath the bottom surface of the trailing section 34 when that bottom surface is in contact with the surface of the carpet. This can increase the agitation of the carpet fibers as the cleaner head 10 is maneuvered over the carpet.

Figure 5:
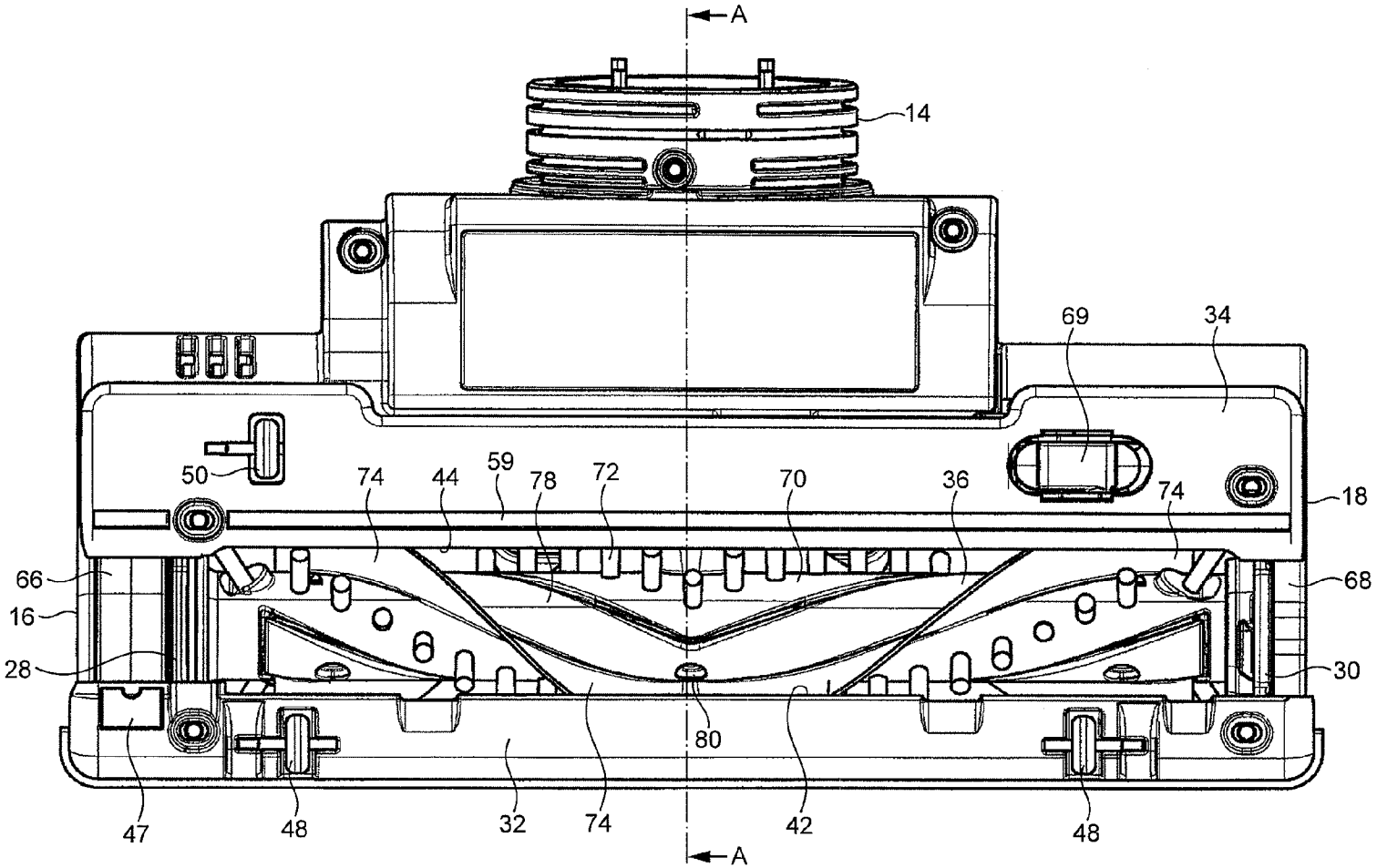
FIG. 5 is a bottom view of the cleaner head.

The inclination of the second plane $P_2$ relative to the third plane $P_3$ results in the rear working edge 44 being raised above the first plane $P_1$ by a distance which is greater than the distance between the front working edge 42 and the first plane $P_1$. In this example, the distance between the rear working edge 44 and the first plane $P_1$ is around 3-4 mm. With reference also to FIG. 5, to provide a seal between the trailing section 34 of the sole plate 26 and a hard floor surface the trailing section 34 comprises a row of bristles 59 which extend downwardly from the bottom surface of the trailing section 34 beyond the first plane $P_1$. The bristles are preferably relatively fine, and are preferably formed from nylon or a similar plastics material so that the bristles 59 deform readily upon contact with a hard floor surface or a carpeted floor surface, and do not impair the maneuvering of the cleaner head 10 over the floor surface. The bristles 59 preferably extend along substantially the entire length of the trailing section 34 of the sole plate 26, as measured in a direction extending along the axis A, and are preferable located adjacent the rear working edge 44.

The cleaner head 10 further comprises an agitator assembly for agitating dirt and dust located on the floor surface. In this example the agitator assembly comprises a rotatable brush bar 60 which is mounted within an agitator chamber 62 of the housing 16. The agitator chamber 62 is partially defined by the curved upper wall 24 of the moveable section 22. The curved upper wall 24 is preferably formed from transparent material to allow the user to see whether the agitator chamber 62 has become blocked. The brush bar 60 is driven by a motor (not shown) located in a motor housing 64 of the main body 12. The motor is electrically connected to a terminal located in the conduit 14 for connection with a conformingly profiled terminal located in a duct of the cleaning appliance to enable electrical power to be supplied to the motor.

The brush bar 60 is connected to the motor by a drive mechanism located, at least in part, within a drive mechanism housing 66 so that the drive mechanism is isolated from the air passing through the suction passage. One end of the brush bar 60 is connected to the drive mechanism to enable the brush bar 60 to be driven by the motor, whereas the other end of the brush bar 60 is rotatably supported by an end cap 68 removably connected to the side wall 18 of the main body 12. A floor engaging sensor 69 is housed within a recess located in the trailing section 34 of the sole plate 26 so as to protrude downwardly beyond the bottom surface of the trailing section 34, and preferably beyond the first plane $P_1$ so that the sensor 69 contacts a floor surface upon which the cleaner head 10 is located to move relative to the sole plate 26. This movement of the sensor 69 causes the motor to be activated to rotate the brush bar 60. When the cleaner head 10 is raised from the floor surface, the resulting movement of the sensor 69 causes the motor to be deactivated.

The brush bar 60 comprises an elongate body 70 bearing two different types of agitating means for agitating dirt and dust from the floor surface as the brush bar 60 is rotated by the motor. Each of the different types of agitating means protrudes from the suction opening 36 in the sole plate 26 by respective different amounts as the brush bar 60 is rotated by the motor.

A first agitating means mounted on the body 70.of the brush bar 60 comprises relatively short, preferably relatively stiff, bristles 72. These bristles 72 are preferably formed from nylon. In this embodiment the relatively short bristles 72 are arranged in two angularly spaced, helical rows extending along the body 70. Within each row, the relatively short bristles 72 are arranged in a series of clusters or tufts regularly spaced along the row. Each tuft preferably comprises around 100 to 150 bristles, with each tuft having a diameter in the range from 2 to 4 mm. The diameter of each bristle 72 is preferably in the range from 100 to 500 μm. The length of the relatively short bristles 72 is chosen so that, as the brush bar 60 is rotated, the tips of these bristles 72 describe a cylindrical volume having a diameter $D_1$ which protrudes outwardly beyond the second plane $P_2$ and the third plane $P_3$, but not beyond the first plane $P_1$.

A second agitating means mounted on the body 70 of the brush bar 60 comprises relatively long, preferably relatively soft, bristles 74. The relatively long bristles 74 protrude radially outwardly from the body 70 beyond the relatively short bristles 72. During rotation of the body 70, the relatively long bristles 74 sweep a cylindrical volume having a diameter $D_2$ which is greater than $D_1$. The difference between $D_1$ and $D_2$ is preferably in the range from 1 to 10 mm, more preferably in the range from 2 to 6 mm. In contrast to the relatively short bristles 72, the length of the relatively long bristles 74 is chosen so that the relatively long bristles 74 protrude beyond both the first plane $P_1$ and the second plane $P_2$ during rotation of the brush bar 60.

The relatively long bristles 74 are formed from material having a lower surface resistivity than the material from which the relatively short bristles 72 are formed. The surface resistivity of the relatively long bristles 74 is preferably in the range from $1\times10^{-5}$ to $1\times10^{12}$ Ω/sq. In comparison, the surface resistivity of the relatively short bristles 72 is preferably higher than $1\times10^{12}$ Ω/sq. The relatively long bristles 74 may be formed from electrically conductive material. The bristles may be formed from metallic, graphite, conductive acrylic or other composite material, but in this example the relatively long bristles 74 comprise carbon fiber bristles.

The body 70 comprises a plurality of angularly spaced, continuous rows of the relatively long bristles 74, which preferably also extend helically along the body 70. In this embodiment the body 70 comprises two continuous rows of the relatively long bristles 74, with each row being angularly spaced from a row of tufts formed from the relatively short bristles 72. Where the relatively long bristles 74 are formed from carbon filaments, the relatively long bristles 74 may be very fine, having a diameter in the range from 5 to 20 μm. In this case, each row of the relatively long bristles 74 may contain in the range from 5,000 to 30,000 bristles per mm length.

With particular reference to FIG. 6, each row of the relatively long bristles 74 is formed from a single strip of bristles. Each strip is preferably formed by attaching an elongate, generally rectangular flexible carrier member 76 to a row of bristles so that each row of bristles 74 protrudes outwardly from a respective long side edge of the carrier member 76. The carrier member may be attached to the row of bristles by stitching or by using an adhesive. Each strip is then located within a respective helical groove formed in the body 70 so that the ends of the bristles protrude outwardly from the body 70. The strips are connected to the body 70 by helical connectors 78 which are mounted on the strips and connected to the body 70 using screws (not shown) which are inserted into apertures 80 formed in the connectors 78. The screws may be pushed through the carrier member, or inserted through apertures formed in the carrier member.

When the cleaner head 10 is located on a carpeted floor surface the wheels 48, 50 sink between the fibers of the carpet so that the bottom surface of the trailing section 34 of the sole plate 26 engages the fibers of the carpet. As both the relatively short bristles 72 and the relatively long bristles 74 protrude from the suction opening 26 as the brush bar 60 rotates, both of the different types of bristles are able to agitate dirt and dust from the floor surface. When an air flow is generated through the suction passage of the cleaner head 10, this dirt and dust becomes entrained within the air flow and is conveyed through the cleaner head 10 to the cleaning appliance.

When the cleaner head 10 is moved from the carpeted floor surface on to a hard floor surface, the sole plate 26 becomes spaced from the hard floor surface by the wheels 48, 50. As the tips of the relatively short bristles 72 do not protrude beneath the first plane $P_1$ containing the lowermost extremities of the wheels 48, 50, these bristles do not come into contact with the hard floor surface, thereby preventing scratching or other marking of the hard floor surface by these bristles. However, as the relatively long bristles 74 protrude beyond this first plane $P_1$, these bristles engage, and are swept across, the hard floor surface with rotation of the brush bar 60. The relatively low surface resistivity of the relatively long bristles 74 inhibits the build up of static electricity on the hard floor surface as the relatively long bristles 74 contact the floor surface, thereby enabling fine dust and powder which would otherwise be attracted to the hard floor surface to be dislodged from the floor surface by these bristles 74 and entrained within the air flow.

The invention claimed is:

1. A cleaner head for a cleaning appliance, the cleaner head comprising:

a rotatable agitator assembly;

an agitator chamber housing the agitator assembly;

a sole plate defining a downwardly-directed opening through which debris energized by the agitator assembly enters the agitator chamber, the opening having a front edge and a rear edge, the sole plate having a leading section extending forwardly from the front edge of the opening and a trailing section extending rearwardly from the rear edge of the opening; and at least one support member located on each section of the sole plate, the support members extending downwardly beyond the sole plate, the support members having a thickness which is less than 5 mm;

wherein the lowermost extremities of the support members are located in a first plane and the edges of the opening are located in a second plane which is inclined upwardly relative to the first plane, and the agitator assembly comprises agitating members which extend outwardly from the opening beyond the second plane but within the first plane.

2. The cleaner head of claim 1, wherein the sole plate is pivotable relative to the agitator chamber.

3. The cleaner head of claim 2, wherein the sole plate is pivotable relative to the agitator chamber about a pivot axis which is substantially parallel to the front edge of the opening.

4. The cleaner head of claim 1, wherein an angle subtended between the first plane and the second plane is less than 10°.

5. The cleaner head of claim 1, wherein an angle subtended between the first plane and the second plane is less than 5°.

6. The cleaner head of claim 1, wherein a bottom surface of one of the sections of the sole plate lies substantially within the second plane.

7. The cleaner head of claim 1, wherein a bottom surface of one of the sections of the sole plate lies beneath the second plane.

8. The cleaner head of claim 7, wherein said bottom surface is contained within a third plane which is angled to the second plane.

9. The cleaner head of claim 8, wherein the third plane intersects the second plane along the rear edge of the opening.

10. The cleaner head of claim 8, wherein an angle subtended between the second plane and the third plane is lower than 5°.

11. The cleaner head of claim 7, wherein said one of the sections comprises at least one flexible surface engaging member extending downwardly from the bottom surface thereof

12. The cleaner head of claim 11, wherein the at least one flexible surface engaging member is adjacent the rear edge of the opening.

13. The cleaner head of claim 11, wherein the at least one flexible surface engaging member comprises a row of bristles.

14. The cleaner head of claim 7, wherein a bottom surface of the other section of the sole plate is inclined to the second plane.

15. The cleaner head of claim 14, wherein the bottom surface of the other section of the sole plate is inclined upwardly relative to the first plane.

16. The cleaner head of claim 1, wherein the agitating members comprise one of a plurality of bristles and a plurality of filaments.

17. The cleaner head of claim 1, wherein the agitator assembly comprises additional agitating members which extend outwardly from the opening beyond both the first plane and the second plane.

18. A cleaner head for a cleaning appliance, the cleaner head comprising:

a rotatable agitator assembly;

an agitator chamber housing the agitator assembly;

a sole plate defining a downwardly-directed opening through which debris energized by the agitator assembly enters the agitator chamber, the opening having a front edge and a rear edge, the sole plate having a leading section extending forwardly from the front edge of the opening and a trailing section extending rearwardly from the rear edge of the opening; and at least one support member located on each section of the sole plate, the support members extending downwardly beyond the sole plate, the support members having a thickness which is less than 5 mm;

wherein the lowermost extremities of the support members are located in a first plane and the edges of the opening are located in a second plane which is inclined upwardly relative to the first plane, and the agitator assembly comprises first agitating members which extend outwardly from the opening beyond both the first plane and the second plane, and second agitating members which extend outwardly from the opening beyond the second plane but within the first plane.

* * * * *